US006674691B1

(12) United States Patent
French et al.

(10) Patent No.: US 6,674,691 B1
(45) Date of Patent: Jan. 6, 2004

(54) RIGID STING EXTENSION FOR OCEAN TURBULENCE MEASUREMENT FROM AN UNMANNED UNDERWATER VEHICLE

(75) Inventors: Daniel W. French, Portsmouth, RI (US); John J. Vaillancourt, Tiverton, RI (US); Edward R. Levine, Newport, RI (US); Rolf G. Lueck, Victoria (CA)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 520 days.

(21) Appl. No.: 09/677,649

(22) Filed: Oct. 3, 2000

(51) Int. Cl.[7] ..... H04R 17/00
(52) U.S. Cl. ..... 367/173; 114/21.3
(58) Field of Search ..... 367/131, 173, 367/154, 153; 114/20.1, 21.3; 73/861.21, 861.23, 861.24; 102/402, 403

(56) References Cited

U.S. PATENT DOCUMENTS 4,079,687 A * 3/1978 Mentcher ..... 114/20.1
4,192,246 A * 3/1980 Hodges et al. ..... 114/20.1
5,363,343 A * 11/1994 Klein ..... 367/173
5,425,001 A * 6/1995 Polvani ..... 114/21.3
5,602,801 A * 2/1997 Nussbaum et al. ..... 367/165
5,657,296 A * 8/1997 Carter ..... 367/173
5,717,658 A * 2/1998 Carter ..... 367/173

* cited by examiner

*Primary Examiner*—Ian J. Lobo
(74) *Attorney, Agent, or Firm*—James M. Kasischke; Jean-Paul A. Nasser; Michael F. Oglo

(57) ABSTRACT

The present invention relates to a system for collecting ocean turbulence data without interference from the hydrodynamic effects of the vehicle. The ocean turbulence data collection system comprises an underwater vehicle, such as an unmanned underwater vehicle, at least one sensor for collecting the ocean turbulence data, and a stinger arrangement mounted to the nose portion of the vehicle for positioning the at least one sensor sufficiently forward of the nose portion of the vehicle to avoid interference from the hydrodynamic effects of the vehicle. The collection system is also provided with at least one accelerometer for compensating for motion not induced by turbulence.

14 Claims, 2 Drawing Sheets

RIGID STING EXTENSION FOR OCEAN TURBULENCE MEASUREMENT FROM AN UNMANNED UNDERWATER VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a system for mounting turbulence sensors in front of an unmanned underwater vehicle undisturbed from the hydrodynamic effects of the leading edge or nose of the unmanned underwater vehicle.

(2) Description of the Prior Art

Underwater vehicles, manned and unmanned, have been used for a variety of different purposes. Depending upon the purpose, one or more sensors may be mounted to the vehicle. For example. U.S. Pat. No. 5,425,001 to Polvani illustrates a method and apparatus for navigating a killer vehicle towards a mine emitting underwater a magnetic field by using measurements of the mine's magnetic field. The measurements are gathered by at least two magnetic sensors affixed to the killer vehicle.

Some underwater vehicles are provided with a folded hydrophone array in their nose, which array forms part of a forward-looking sonar for obstacle avoidance, mine detection, and the like. U.S. Pat. Nos. 5,363,343 to Klein and 5,602,801 to Nussbaum et al. illustrate such vehicles.

Yet other underwater vehicles have been provided with acoustic transducer means for detecting the presence of a target mounted to a nose portion of the underwater vehicle. U.S. Pat. No. 4,079,687 to Mentcher, for example, illustrates one such vehicle having a detachable acoustic acquisition system mounted to the nose of the vehicle.

Unmanned underwater vehicles also have been used to collect ocean turbulence data; however, the sensors have been mounted on these vehicles in a way which allowed the hydrodynamic effects of the unmanned underwater vehicles to interfere with the data gathering operations.

SUMMARY OF THE INVENTION

Accordingly, it is an object of the present invention to provide an underwater vehicle which can be used to collect ocean turbulence data without interference from the hydrodynamic effects of the vehicle.

It is a further object of the present invention to provide an improved system for mounting sensors to the nose of an underwater vehicle.

It is yet a further object of the present invention to provide an improved mounting system which documents and removes any noise caused by the mounting system.

These and other objects are accomplished with the present invention by providing a system for collecting ocean turbulence data which includes an underwater vehicle having a means for collecting ocean turbulence data without interference from the hydrodynamic effects of the vehicle. The data collecting means comprises at least one sensor for collecting the ocean turbulence data and means for positioning the at least one sensor sufficiently forward of the nose of the vehicle to avoid interference from the hydrodynamic effects of the vehicle. The data collecting means is also provided with means for compensating for motion not induced by turbulence.

Other details of the present invention, as well as other objects and advantages attendant thereto, are set forth in the following description and the accompanying drawings in which like reference numerals depict like elements.

DESCRIPTION OF THE PREFERRED EMBODIMENTS

Figure 1:
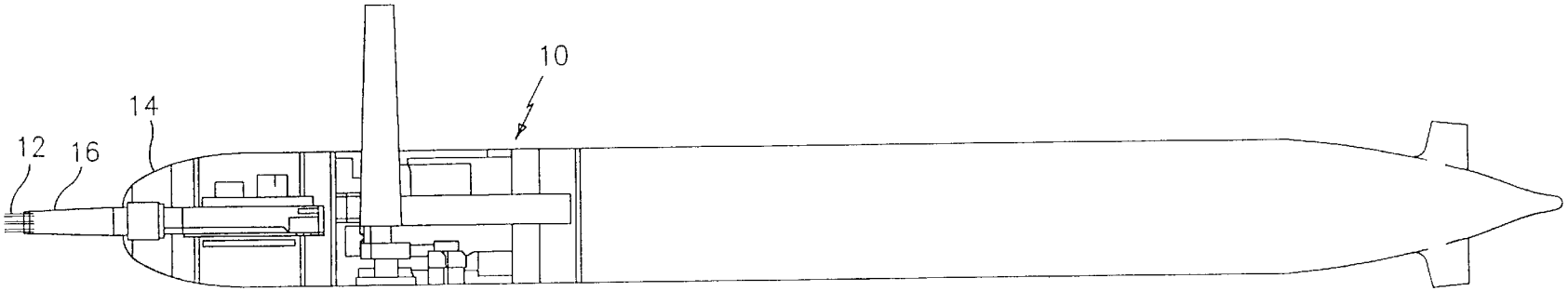
FIG. 1 is a side sectional view of an unmanned underwater vehicle having a system for mounting turbulence sensors in accordance with the present invention.
Figure 3:
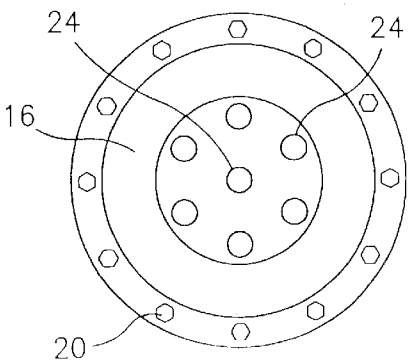
FIG. 3 is a front view of a stinger used to mount the turbulence sensors to the nose of the unmanned underwater vehicle.
Figure 2:
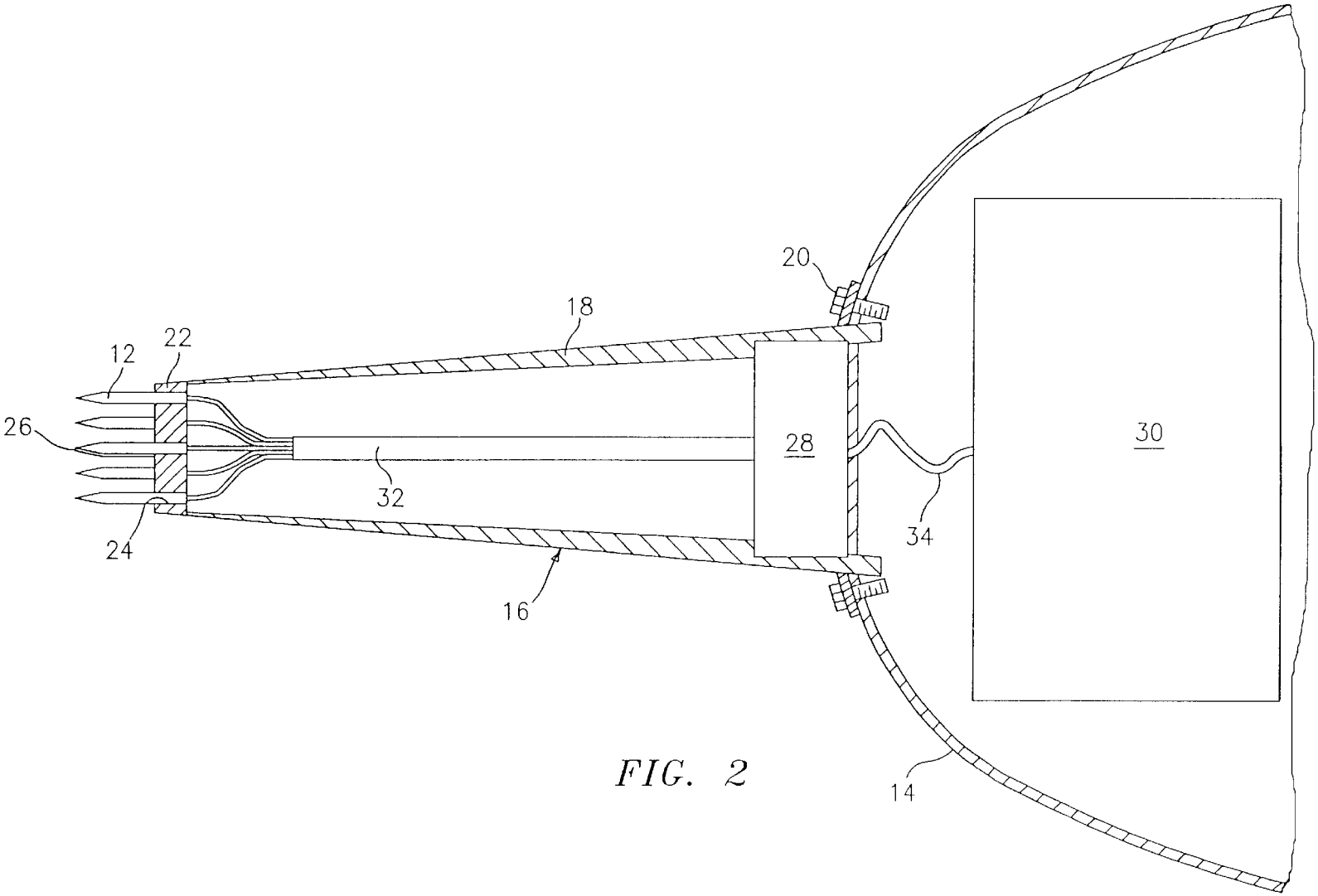
FIG. 2 is an enlarged sectional view of the system for mounting turbulence sensors to the nose of an unmanned underwater vehicle.

Referring now to the drawings, FIG. 1 illustrates an unmanned underwater vehicle 10 having a plurality of turbulence sensors 12 mounted to the forward end or the nose portion 14 of the vehicle 10 by a stinger 16. Referring now to FIGS. 2 and 3, the stinger 16 is rigidly mounted to the nose portion 14 of the vehicle 10. The stinger 16 preferably is formed by a tapered cylindrical housing 18. In a preferred embodiment of the present invention, the housing 18 is joined to the nose portion 14 by a bolt ring 20 which may also provide a water tight seal if required. The housing 18 may be formed from any suitable material known in the art which is capable of withstanding the depths at which the vehicle 10 is intended to operate and which is waterproof. For example, the housing 18 may be formed from a high strength, lightweight metallic material.

As shown in FIGS. 2 and 3, the forward end 22 of the housing 18 has a plurality of apertures 24 for receiving and accommodating the sensors 12. The apertures 24 may be arranged in any desired manner. For example, there may be seven apertures 24 with six of the apertures being arranged in a circle and the seventh aperture being positioned at the center of the circle. Turbulence sensors 12 are positioned in the apertures 24 and have leading edges 26 which are located in front of the forward end 22 of the housing 18. The housing 18 has a length sufficient to position the sensors 12 so that they are not disturbed by hydrodynamic effects of the nose portion 14 of the vehicle 10.

The turbulence sensors 12 may comprise any suitable sensors known in the art for measuring hydrodynamic turbulence. Preferably, the turbulence sensors 12 are shear detectors that are capable of detecting transverse shear. This includes shear in vertical and athwartship directions. Typically, the sensors 12 cannot detect shear in an axial direction.

It is desirable that the data being gathered by the sensors 12 be gathered in a non-corrupt manner. To this end, one or more accelerometers 28 are positioned within the base of the housing 18. The accelerometers 28 may be secured in a block as shown in FIG. 2. The purpose of the accelerometers 28 is removing vibrational noise caused by the stinger itself from the turbulence data.

A monitoring device 30 is positioned within the nose 14 of the vehicle 10. The monitoring device 30 can be any suitable means known in the art for collecting the data gathered by the sensors 12 and storing it for later downloading and documentation. A stinger communication cable 32 extends between the accelerometers 28 and each of the sensors 12. A data cable 34 connects the monitoring device 30 to the accelerometers 28 and the turbulence sensors 12. The accelerometers 28 detect motion caused by the vehicle 10 so as to compensate for motion not induced by turbulence. In a preferred embodiment, the cable 32 is mounted to a rigid structure. This allows the cable to be secured and aligned inside the stinger 16.

The principal advantage of the system for mounting turbulence sensors in front of an unmanned underwater vehicle of the present invention is that it allows data to be collected in its pure form. There are no disturbances from the unmanned underwater vehicle. Further, any vibration noise from the stinger is documented and removed.

The mounting system of the present invention allows a wide range of probes or sensors to be used. Overall size and length could be changed depending on the nature of the data to be collected.

While the mounting system of the present invention has been described in the context of unmanned underwater vehicles, it should be recognized that it could also be used on manned underwater vehicles.

While the housing 18 has been shown as having a plurality of apertures 24, it is possible to construct the housing 18 with a single aperture for housing a single sensor.

It is apparent that there has been provided in accordance with the present invention a rigid sting extension for ocean turbulence measurement from an unmanned underwater vehicle which fully satisfies the means, objects and advantages set forth hereinbefore. While the present invention has been described in the context of particular embodiments thereof, it is apparent that there are many alternatives, modifications, and variations which could be made. It is intended to embrace such alternatives, modifications, and variations as fall within the scope of the appended claims.

What is claimed is:

1. A sensor mounting system for an underwater vehicle nose comprising:

a sensor means attached to said vehicle nose for collecting data without interference from hydrodynamic effects of said vehicle; and a mounting means has tapered cylindrical housing affixed to said vehicle nose mounting said sensor means sufficiently forward of said vehicle nose for avoiding interference from the hydrodynamic effects of the vehicle.

2. The system according to claim 1, wherein said tapered cylindrical housing has a hollow interior, a forward end, and at least one aperture in said forward end, said sensor means being received in said aperture.

3. The system according to claim 2, wherein said sensor means comprises a plurality of sensors and said tapered cylindrical housing forward end has a plurality of apertures for receiving said plurality of sensors.

4. The system according to claim 2, further comprising compensating means joined to said underwater vehicle for compensating for motion not induced by turbulence.

5. The system according to claim 4 wherein said compensating means comprises motion detecting means for detecting motion caused by the vehicle.

6. The system according to claim 5 wherein said motion detecting means comprises at least one accelerometer joined to said underwater vehicle within the hollow interior of said housing.

7. The system according to claim 6, further comprising:

a monitoring device positioned within said vehicle; and connecting means joining said monitoring device to said at least one sensor and said accelerometer, said monitoring device collecting data from said at least one sensor and said at least one accelerometer.

8. The system according to claim 1 wherein said housing is affixed to said nose of said vehicle by a bolt ring.

9. The system according to claim 1 wherein said sensor means comprises at least one shear detector capable of detecting transverse shear.

10. The system according to claim 1 wherein said sensor means comprises at least one detector capable of detecting shear in vertical and athwartship directions.

11. An underwater vehicle for use in the collection of ocean turbulence data comprising:

a hull having a nose;

sensor means affixed to said nose for collecting ocean turbulence data; and positioning means joined to said sensor means for positioning said sensor means sufficiently forward of said nose in order that hydrodynamic effects created by said nose do not affect the ocean turbulence data being gathered by said sensor means.

12. The underwater vehicle of claim 11 wherein said positioning means comprises:

a tapered hollow cylindrical housing having an aft end and a forward end with a plurality of apertures therein, said aft end being bolted to said hull at said nose; and said sensor means being mounted in said plurality of apertures in said tapered hollow cylindrical housing.

13. The underwater vehicle of claim 12 further comprising at least one accelerometer positioned within said housing for detecting motion caused by said vehicle and compensating therefor.

14. The underwater vehicle of claim 13 further comprising a monitoring device positioned within said hull and in communication with said sensor means and said at least one accelerometer for receiving said data from said sensor means and detected motion from said at least one accelerometer.

* * * * *